United States Patent [19]

Marshall et al.

[11] 4,040,942

[45] Aug. 9, 1977

[54] MULTIPLE-TRACK CATHODE FOR ELECTROFORMATION OF METALLIC FILAMENTS

[75] Inventors: David W. Marshall, North Reading; Kenneth W. MCGrath, Attleboro, both of Mass.; William R. O'Day, Jr., Brookfield, Wis.; Thomas C. Wilder, Cambridge, Mass.

[73] Assignee: Kennecott Copper Corporation, New York, N.Y.

[21] Appl. No.: 716,839

[22] Filed: Aug. 23, 1976

[51] Int. Cl.[2] ..... C25D 1/04; C25D 1/20

[52] U.S. Cl. ..... 204/13; 204/208; 204/281

[58] Field of Search ..... 204/281, 216, 13, 208

[56] References Cited

U.S. PATENT DOCUMENTS

| | | | |
|---|---|---|---|
| 528,586 | 11/1894 | Bridgman | 204/281 |
| 799,634 | 9/1905 | Cowper-Coles | 204/281 |
| 3,094,476 | 6/1963 | Francis | 204/216 |
| 3,700,012 | 10/1972 | Alderfer | 140/149 |
| 3,872,659 | 3/1975 | Campbell et al. | 57/33 |
| 3,929,610 | 12/1975 | Wang | 204/13 |

FOREIGN PATENT DOCUMENTS

| | | | |
|---|---|---|---|
| 1,021,087 | 2/1966 | United Kingdom | 204/281 |
| 1,220,002 | 1/1971 | United Kingdom | |

*Primary Examiner*—T. M. Tufariello

*Attorney, Agent, or Firm*—John L. Sniado; Anthony M. Lorusso

[57] ABSTRACT

Disclosed is an improved cathode arrangement for use in the electroformation of metallic filaments. The cathode includes a plurality of closed-loop plating surfaces that are congruent to, and interleaved with, each other. This pattern of plating surfaces facilitates the simultaneous stripping of a number of filaments reducing the likelihood of mutual interference among the filaments being stripped.

10 Claims, 5 Drawing Figures

MULTIPLE-TRACK CATHODE FOR ELECTROFORMATION OF METALLIC FILAMENTS

BACKGROUND OF THE INVENTION

The present invention relates to the electroformation of metallic filaments and, more particularly, to an improved cathode arrangement that facilitates the production of a number of fine metallic filaments.

The deposition of metal on a plating surface, and the stripping of metal so deposited, has been a repeatedly proposed technique for forming metallic filaments, strands, or wires over the years. Various problems of previously proposed arrangements (e.g., short cathode lifetime, very low permissible stripping rate for the filaments, etc.) were overcome by an arrangement proposed in Wang U.S. Pat. No. 3,929,610, issued Dec. 30, 1975, owned by the assignee of the present invention, and incorporated herein by reference. This Wang patent teaches a very desirable closed-loop double spiral plating track pattern for a cathode. The present invention is concerned with modifications in such a cathode that facilitate the incorporation of such an electrodeposition technique into a total stranded wire fabrication system, such as described in contemporaneously filed patent application entitled "Flexible Electrical Conductor and Method of Manufacturing Same", assigned to the assignee of the present application. Furthermore, certain improvements according to the present invention facilitate filament production, using the basic technique of the Wang patent, whatever the end use of the filaments produced.

SUMMARY OF THE INVENTION

The present invention is direct to an improved cathode for the continuous electroformation of metallic filaments, the cathode comprising an electrically conductive base having a closed-loop plating pattern on a surface of the base. The improved pattern comprises a plurality of substantially congruent, interleaved, narrow plating surfaces, and insulating regions on the base intermediate those plating surfaces. This arrangement facilitates the simultaneous electroformation of a plurality of filaments in patterns that enable the simultaneous removal of the filaments from the cathode without substantial interference between filaments.

In a particular preferred embodiment, the plating surfaces intersect each other at spaced apart locations along their length, thereby resulting in filaments that are fused to each other at such spaced apart locations. Such fused filaments facilitate the stripping of the filaments from the cathode, since the breakage of a filament will not interrupt the stripping of that filament because it will be pulled along owing to its fusion to other filaments. Preferably, three such plating surfaces are provided, at least two of them havng a sinusoidal pattern that intersects an adjacent plating surface pattern at spaced apart locations.

BRIEF DESCRIPTION OF THE DRAWINGS

Other objects, features, and advantages of the invention will appear from the following description of particular preferred embodiments, taken together with the accompanying drawings in which.

DETAILED DESCRIPTION OF PARTICULAR PREFERRED EMBODIMENTS

Figure 1:
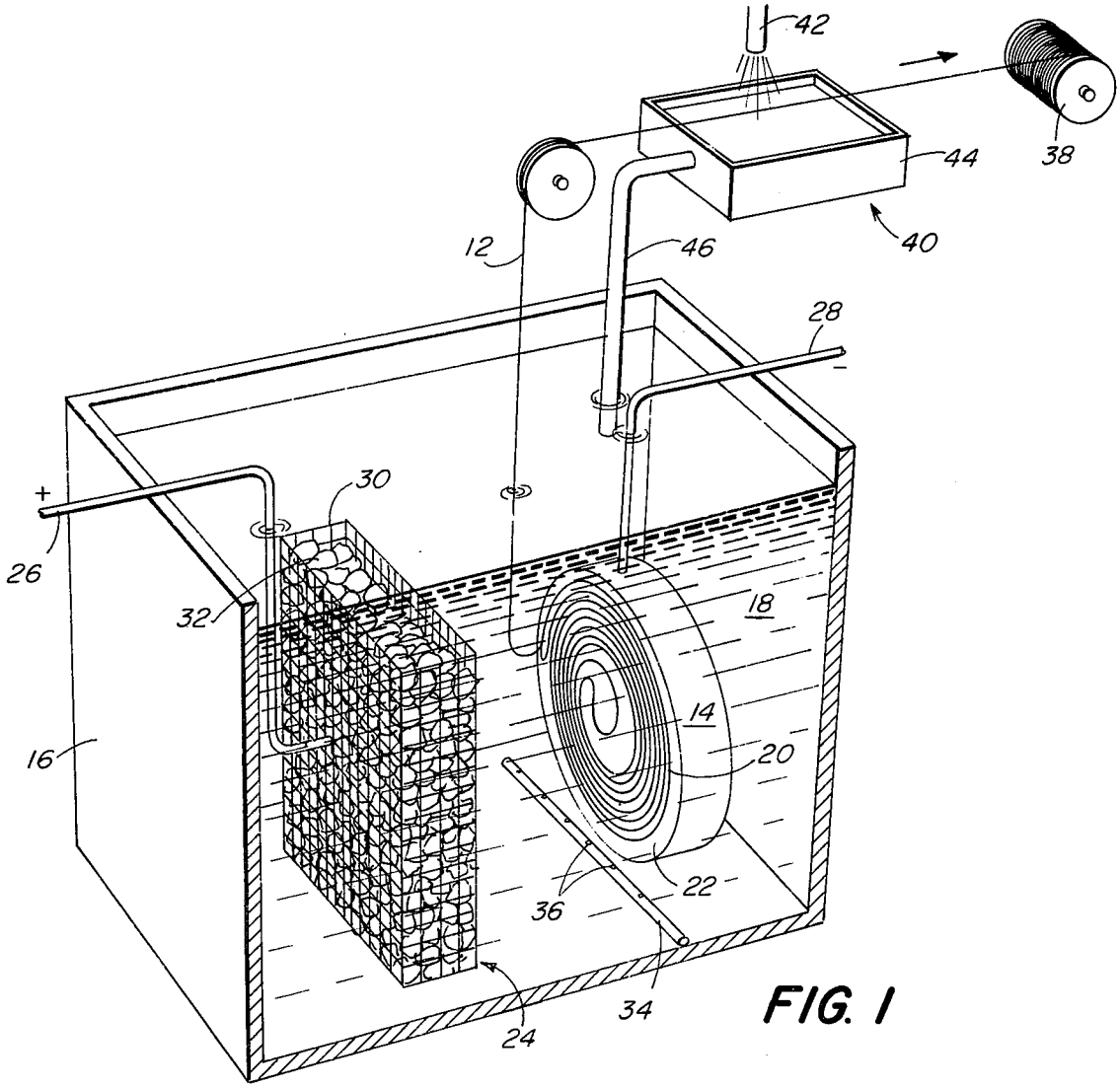
FIG. 1 is a partially schematic and partially brokenaway perspective view of an apparatus for producing metallic filaments in accordance with this invention.

With reference to FIG. 1, a plurality 12 of strands or filaments of metal are formed on a cathode 14 immersed in a plating tank 16 containing an electrolytic solution 18. The strands are formed on a plating pattern 20 of the cathode 14 and are removed, after a starting procedure, discussed below, continuously and simultaneously. The plating pattern 20 comprises a closed-loop formation of conductive material that is substantially inert or strippable with respect to the metal being plated. Portions of the face 22 of cathode 14 intermediate the conductive material forming the pattern 20 are covered with an insulating material, as described in greater detail in the above mentioned U.S. Pat. No. 3,929,610. A power source is connected between the cathode 14 and an anode 24 via insulated leads 26 and 28.

As mentioned above, the conductive material which forms the plating pattern 20 is strippable with respect to the metal being deposited. As used herein, the term "strippable" excludes any material which would adversely affect plating surface of the material itself or the metal being deposited, as well as materials which are physically reactive in a sense of generating a deposit of metal which adheres so strongly to the plating surface that it renders the efficient removal of the strand 12 impractical. For example, in the electroformation of copper filaments, suitable strippable materials include stainless steel, chromium, titanium, rhenium, and molybdenum.

For purposes of illustration only, the following discussion will assume that the apparatus of FIG. 1 is to produce copper strands. In that case, the anode 24 may consist of a titanium wire basket 30 containing lumps of copper 32, which may be of a relatively low grade. The cathode 14 and anode 24 are immersed in a spaced relationship, in the plating solution 18, which may be of a conventional composition (e.g., 240 grams per liter of hydrated copper sulfate and 75 grams per liter of sulfuric acid, at room temperature). With this arrangement, a layer of copper is deposited on the plating surfaces of the pattern 20 with the rate of deposition depending, as is known, on such variables as the current density and the chemistry of the plating solution. Given a constant current density at the cathode, the amount of deposition is directly proportional to the elasped time.

An air supply line 34 is immersed in the tank 24 adjacent the bottom edge of the vertically disposed cathode face 22. Conventional air line connections are provided (not shown) to deliver water saturated compressed air to the line 34 for release through nozzle openings 36 to provide air-agitation of the electrolyte 18 adjacent the cathode face 22 to increase the plating rate. Not illustrated are conventional plumbing, and other fittings that maintain the electrolyte at a suitable level, temperature, and chemical composition.

As they are produced, filaments 12 are pulled from the cathode face as a group by a driven take-up spool 38. The spool 38 pulls the stripped filaments 12 through a washing station 40 that comprises a water nozzle 42 connected to a water supply line (not shown) and a collection trough 44 disposed beneath the filaments 12. The stripping rate determines the thickness of the filaments having a relatively reproducible cross sectional area at a constant plating rate.

Figure 2:
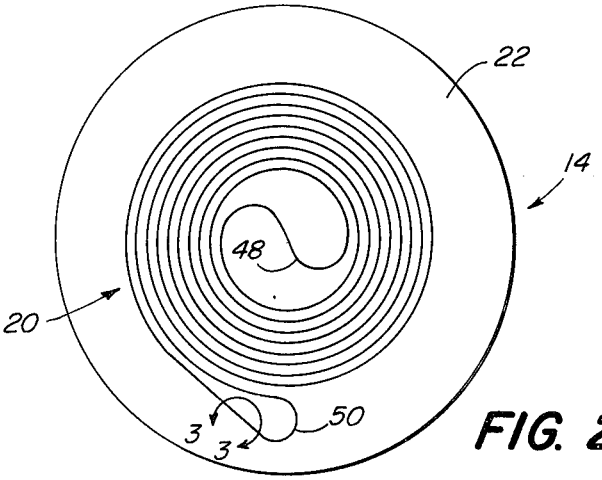
FIG. 2 is a plan view of the pattern on a face of a cathode suitable for use in the apparatus of FIG.1.
Figure 3:
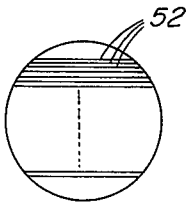
FIG. 3 is a greatly enlarged view of a small portion of the cathode face of FIG. 2.

Referring to FIGS. 2 and 3, it will be seen that, in this embodiment, the closed-loop plating pattern 20 is in the form of a double spiral, which can be visualized as formed by spiral winding a plurality of long, continuous members meeting in common end loops 48, 50. Advantages of this particular configuration include: (a) each complete loop around the plating pattern is relatively long thereby permitting time for adequate deposition of metal even with a relatively rapid stripping speed, (b) a strand production per unit area of the cathode is high, and (c) there are no sharps bends in the pattern which might interfere with the removal of the typicaly delicate metallic filaments depositied on the pattern.

The outermost convolution of the 20 is partially shown in the greatly enlarged view of FIG. 3. As is evident from FIG. 3, the pattern 20 is actually formed from a plurality (e.g., three to forty) of individual plating surfaces 52 which are separated by regions of insulation. Each of the surface 52 thus forms its own closed-looped double spiral substantially congruent (i.e., substantially of the same size and shape) to each other double spiral. The plating pattern 20 therefore consists of the totality of these very narrow double spiral plating surfaces 52. The surface 52, and the intermediate insulating areas, can be formed with various techniques, some of which are described in greater detail in the above mentioned U.S. Pat. No. 3,929,610.

A typical usage of the very fine filaments 12 produced by a plating pattern 20 such as is illustrated in FIGS. 2 and 3 would be as input to a twisting or bunching apparatus in accordance with a patent application filed contemporaneously herewith, entitled "Flexible Electrical Conductor and Method of Manufacturing Same", and assigned to the assignee of the present application.

Figure 4:
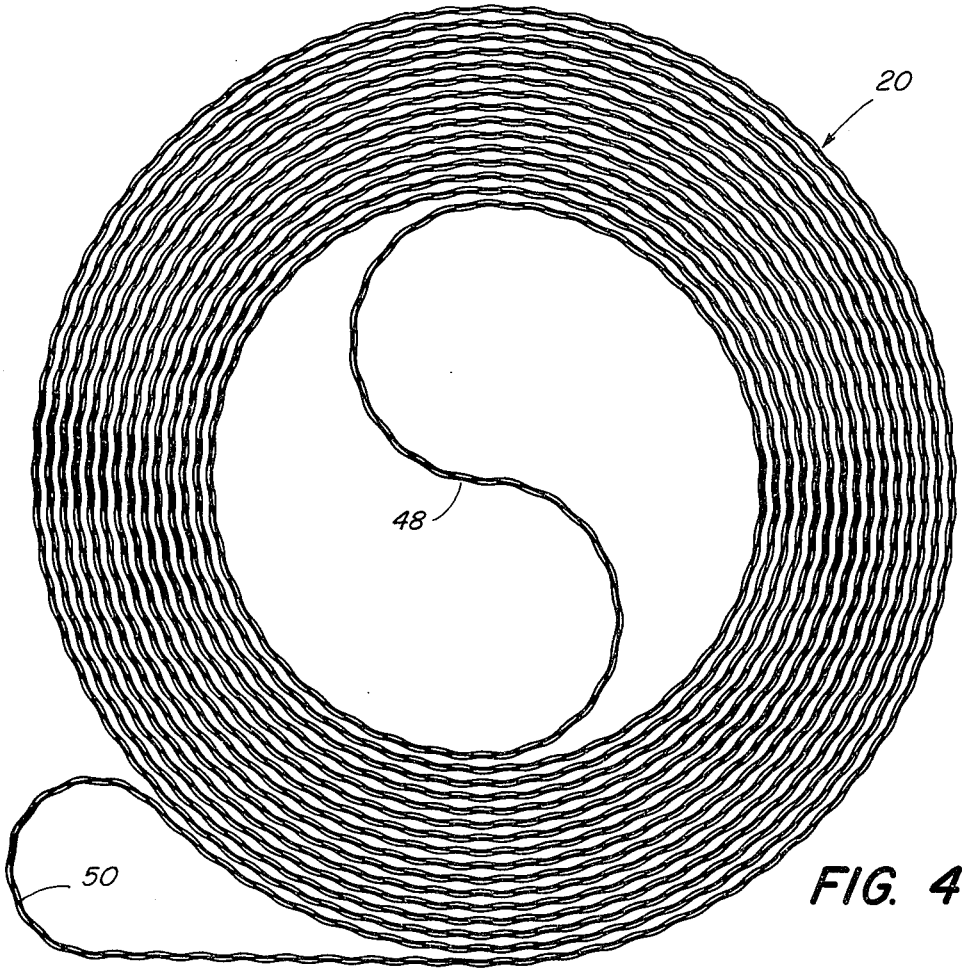
FIGS. 4 and 5 are views similar to FIGS. 2 and 3 of an alternative cathode pattern.
Figure 5:
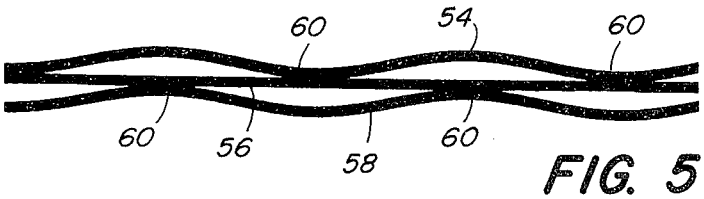

In the embodiment of FIGS. 4 and 5, the double spiral pattern 20 is formed from three plating tracks 54, 56, 58. Tracks 54 sand 58 have an undulatory shape with a periodicity very small compared to the dimensions of the pattern 20 as a whole. These undulatory shapes, which may be sinusoidal, intersect track 56 at locations 60. This arrangement of the tracks, of course, results in the deposited filaments being fused to each other at spaced apart locations along their lengths corresponding to the locations 60 in the pattern of plating tracks. This fusing simplifies stripping and handling of the typically delicate copper filaments. For example, a breakage in one of the filaments, between fusion points corresponding to the locations 60, will not result in an interruption of the stripping of that filament from the cathode face. Naturally, different local shapes of tracks 54, 56, 58 can yield the desired intersections.

Depending upon the ultimate use of the filaments, different choices of periodicity and/or amplitude of the undulating plating tracks 54, 56 and 58 may be chosen. For example, the outermost track with respect to the center of the pattern 20 (i.e., track 58 of FIG. 5) may have a smaller amplitude than the inner track, both periods being the same. Such a choice is conducive to an equilization in the lengths of the filaments produced on those tracks when the resulting fused filaments are straightened and stretched, as may occur prior to, and during a twisting or bunching operation involving a plurality of "triplet" filament groups.

While particular preferred embodiments of the present invention have been illustrated in the accompanying drawings and described in detail herein, other embodiments are within the scope of the invention and the following claims.

We claim:

1. In a cathode for total immersion in a plating solution for the continuous electroformation of metallic filaments, comprising an electrically conductive closed-loop plating pattern on a planar surface of said cathode, the improvement wherein said pattern comprising of substantially congruent adjacent narrow plating surfaces, and insulating regions intermediate said plating surfaces; whereby a plurality of filaments are simultaneously electroformed on said cathode in patterns that enable simultaneous stripping from said cathode of all filaments deposited on said plating surfaces.

2. In the cathode of claim 1, the further improvement wherein said plating pattern is in the form of a closed-loop double spiral.

3. In the cathode of claim 2, the further improvement wherein each plating surface of said plurality contacts said insulating regions at the edges of said plating surface.

4. In the cathode of claim 2, the further improvement wherein at least one of said plating surfaces intersects another of said plating surfaces at spaced apart locations along the length of said one plating surface.

5. In the cathode of claim 4, the further improvement wherein all plating surfaces intersect at least one other plating surface at spaced apart locations along the lengths of the plating surfaces.

6. In the cathode of claim 5, the further improvement wherein are three plating surfaces.

7. In the cathode of claim 6, the further improvement wherein at any location along said plating pattern said plating surfaces consists of, with respect to the center of said pattern, an outer plating surface, a central plating surface, and an inner plating surface; at least said outer and said inner plating surfaces being undulatory and intersecting said center plating surface at spaced apart locations.

8. In the cathode of claim 7, the further improvement wherein said undulatory plating surfaces have a sinusoidal shape.

9. In the cathode of claim 8 the further improvement wherein the amplitude of the sinusoidal shape of said outer plating surface is less than the amplitude of the sinusoidal shape of said inner plating surface.

10. In the cathode of claim 9 the further improvement wherein the periods of the sinusoidal shapes of said plating surfaces are the same.

* * * * *